US007070347B2

(12) United States Patent
Carriere et al.

(10) Patent No.: US 7,070,347 B2
(45) Date of Patent: Jul. 4, 2006

(54) PRINTER WITH A PIVOTING GEAR MECHANISM

(75) Inventors: Richard L. Carriere, Oak Creek, WI (US); Kevin L. Wilken, Wauwatosa, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 10/639,548

(22) Filed: Aug. 12, 2003

(65) Prior Publication Data

US 2005/0036812 A1 Feb. 17, 2005

(51) Int. Cl.
*B41J 33/44* (2006.01)

(52) U.S. Cl. ..... 400/221; 400/234

(58) Field of Classification Search ..... 400/221, 400/221.2, 234

See application file for complete search history.

(56) References Cited

U.S. PATENT DOCUMENTS

| | | | | | |
|---|---|---|---|---|---|
| 3,825,103 | A | * | 7/1974 | Riley | 400/219.5 |
| 3,854,670 | A | * | 12/1974 | Bertolazzi | 400/219 |
| 3,948,382 | A | | 4/1976 | Nesbitt et al. | |
| 4,034,619 | A | * | 7/1977 | Seregni | 74/384 |
| 4,182,576 | A | * | 1/1980 | Fujimori et al. | 400/221 |
| 4,342,520 | A | * | 8/1982 | Isobe et al. | 400/221 |
| 4,609,299 | A | * | 9/1986 | Hattori et al. | 400/229 |
| 4,707,154 | A | | 11/1987 | Arai | |
| 4,934,847 | A | | 6/1990 | Shiozaki et al. | |
| 4,958,782 | A | | 9/1990 | Dannatt et al. | |
| 5,078,523 | A | | 1/1992 | McGourty et al. | |
| 5,137,378 | A | | 8/1992 | Satoh | |
| 5,372,439 | A | | 12/1994 | Poole et al. | |
| 5,415,482 | A | | 5/1995 | Poole et al. | |
| 5,542,769 | A | | 8/1996 | Schneider et al. | |
| 5,593,238 | A | | 1/1997 | Fox et al. | |
| 5,700,096 | A | | 12/1997 | Satoh et al. | |
| 5,718,522 | A | | 2/1998 | Kang | |
| 5,951,177 | A | * | 9/1999 | Schanke et al. | 400/218 |
| 6,082,912 | A | | 7/2000 | Shimizu et al. | |
| 6,113,293 | A | | 9/2000 | Schanke et al. | |
| 6,126,344 | A | * | 10/2000 | Takayama et al. | 400/615.2 |
| 6,266,075 | B1 | | 7/2001 | Feitel et al. | |

FOREIGN PATENT DOCUMENTS

| | | |
|---|---|---|
| EP | 0 807 530 A1 | 11/1997 |
| JP | 2002 002053 | 1/2002 |
| WO | WO 9605968 A1 | 2/1996 |

OTHER PUBLICATIONS

PCT International Search Report.
Patent Abstracts of Japan, vol. 2002, No. 5 (May 3, 2002).

* cited by examiner

*Primary Examiner*—Daniel J. Colilla
*Assistant Examiner*—Jill E. Culler
(74) *Attorney, Agent, or Firm*—Quarles & Brady LLP

(57) ABSTRACT

A printer, suitable for use in a hand held printer, having a dual direction drive mechanism for driving ink ribbon in a forward feed direction and a reverse feed direction. The drive mechanism is mounted in a printer body, and includes a stationary gear drive assembly engageable with a pivotal drive gear assembly having a forward feed position and a reverse feed direction.

19 Claims, 8 Drawing Sheets

PRINTER WITH A PIVOTING GEAR MECHANISM

CROSS REFERENCES TO RELATED APPLICATIONS

Not Applicable

STATEMENT REGARDING FEDERALLY SPONSORED RESEARCH

Not Applicable

TECHNICAL FIELD

The present invention relates to a thermal transfer printer, and more particularly to a printer having a dual direction drive mechanism for driving ink ribbon and/or label media in a forward feed direction and a reverse feed direction.

DESCRIPTION OF THE BACKGROUND ART

There are a number of U.S. patents that disclose electronic apparatus for printing indicia on labels, some of these are restricted to hand held units and others that disclose tabletop units. Hand held label printers, such as disclosed in U.S. Pat. No. 6,113,293, and tabletop printers, such as disclosed in U.S. Pat. Nos. 6,266,075 and 5,078,523, include the same general combination of elements, a print head, means for feeding label media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a light emitting diode (LED) or liquid crystal display (LCD) unit to assist the operator in using the printer. In a hand held printer, these components may all be enclosed in a single housing.

The label media comprises a series of labels that are attached to a carrier strip. The carrier strip is fed through the printer and legends, alphanumeric characters, and other indicia, are printed on the labels. The labels are then removed from the carrier and attached to the objects needing identification. As there are many types of label applications, there are many combinations of labels and carrier strips that provide labels of varying sizes, colors and formats.

A particular type of print head employs thermal transfer printing technology. Thermal transfer printing uses a heat generating print head to transfer a pigment, such as wax, carbon black, or the like, from a thermal transfer ribbon to a label media. By using digital technology, characters are formed by energizing a sequence of pixels on the print head which in turn melts the wax or other pigment on the ink ribbon transferring the image to the label media.

In a known thermal transfer printer such as a label printer, label media and ink ribbon are simultaneously fed past the print head by a platen roller in an overlay relationship between the print head and the platen roller. The platen roller is rotatably driven by a drive mechanism that may also rotatably drive ink ribbon take up and supply spools to maintain tension in the ink ribbon.

Preferably, the drive mechanism can feed the ink ribbon and label media past the print head in a forward feed direction when printing a label and in a reverse feed direction to minimize wasting unprinted labels or unused ink ribbon. Unfortunately, dual feed direction drive mechanisms are typically very complicated and expensive and/or require multiple drive motors which take up a lot of space in the printer housing. As a result, hand held printers cannot feed the label media and/or ink ribbon in more than one direction or are rather large requiring more than one hand to carry. Therefore, a need exists for a hand held printer having a simple dual feed direction drive mechanism that is more cost effective, and, preferably, requires only one drive motor.

SUMMARY OF THE INVENTION

The present invention provides a printer, suitable for use in a hand held printer, having a dual direction drive mechanism for driving ink ribbon in a forward feed direction and a reverse feed direction. The drive mechanism is mounted in a printer body, and includes a ribbon rewind gear, a ribbon unwind gear, and a rotatably driven drive. The ribbon rewind gear is rotatably mounted in the body for rotatably driving an ink ribbon take up spool to wind the ink ribbon thereon when the ink ribbon is driven in the forward feed direction. The ribbon unwind gear is rotatably mounted in the body and spaced from the ribbon rewind gear for rotatably driving an ink ribbon supply spool to wind the ink ribbon thereon when the ink ribbon is driven in the reverse feed direction. The rotatably driven drive gear is rotatably mounted in the body and spaced from the ribbon unwind gear and the ribbon rewind gear. The drive gear is selectively rotatably driven in a first direction of rotation and a second direction of rotation.

A drive gear assembly engageable with the ribbon unwind and rewind gears is pivotally mounted in the body and pivotally movable between a first feed position and a second feed position. The drive gear assembly includes a pivoting gear and at least one transition gear. The pivoting gear is rotatably mounted in the body and engages the drive gear and the at least one transition gear. Upon rotation of the drive gear in the first direction of rotation, the drive gear assembly pivots from the first feed position to the second feed position to engage the at least one transition gear with the ribbon rewind gear. Upon rotation of the drive gear in the second direction of rotation, the drive gear assembly pivots from the second feed position to the first feed position to disengage the at least one transition gear from the ribbon rewind gear and engage at least one of the at least one transition gear with the ribbon unwind gear.

A general objective of the present invention is to provide a printer that can feed the ink ribbon in both a forward feed direction and a reverse feed direction. This objective is accomplished by providing a printer with a drive mechanism having a pivotal drive gear assembly having a forward feed position and a reverse feed position, wherein in the forward feed position, the drive gear assembly drives the ink ribbon in a forward feed direction, and in the reverse feed position, the drive gear assembly drives the ink ribbon in the reverse feed position.

Another objective of the present invention is to provide a printer having a dual feed direction drive mechanism that is driven by a single motor. This objective is accomplished by providing the pivotal gear assembly that is driven by a single motor.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

Figure 1:
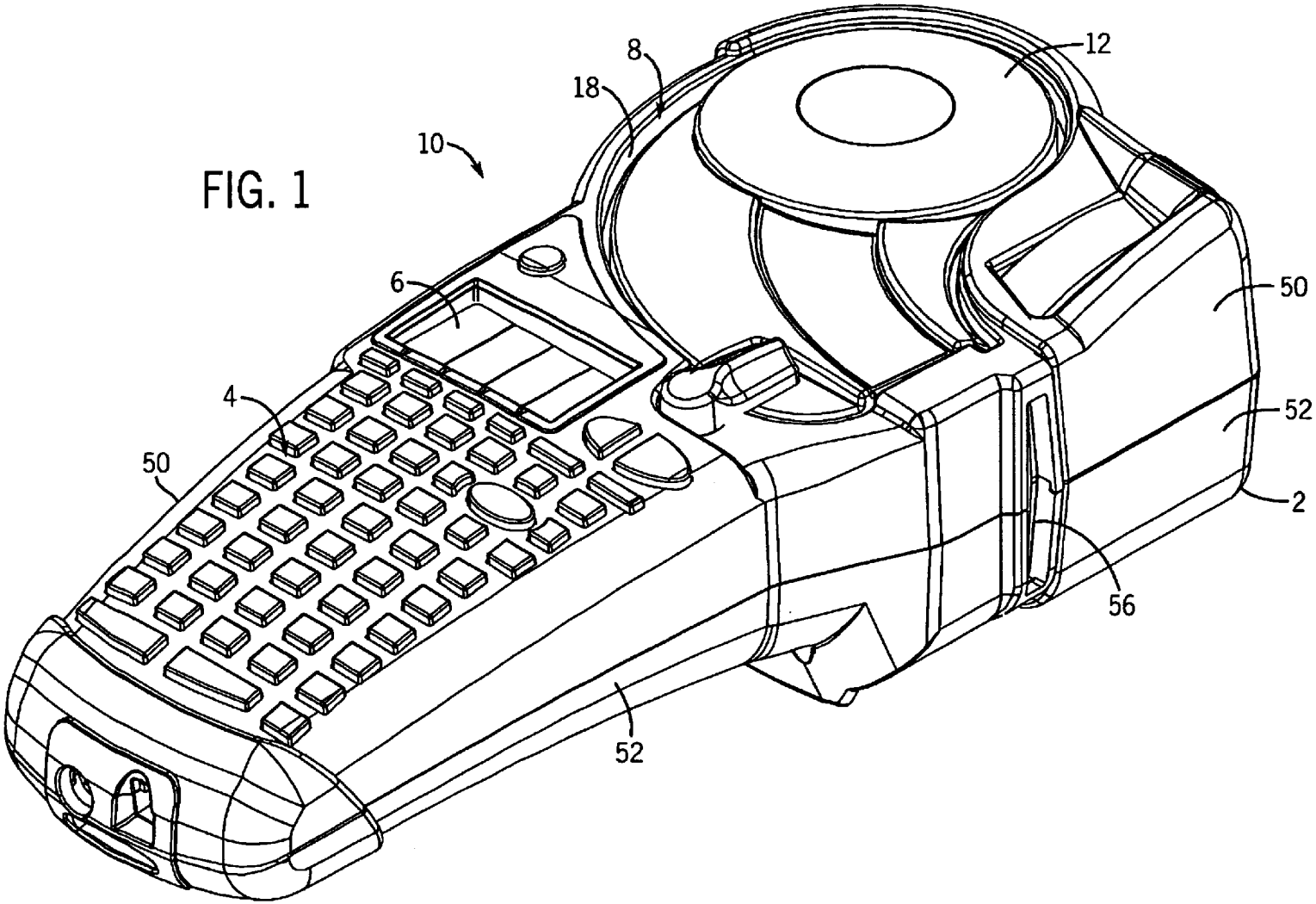
FIG. 1 is a perspective view of a hand held label printer which employs the present invention.
Figure 2:
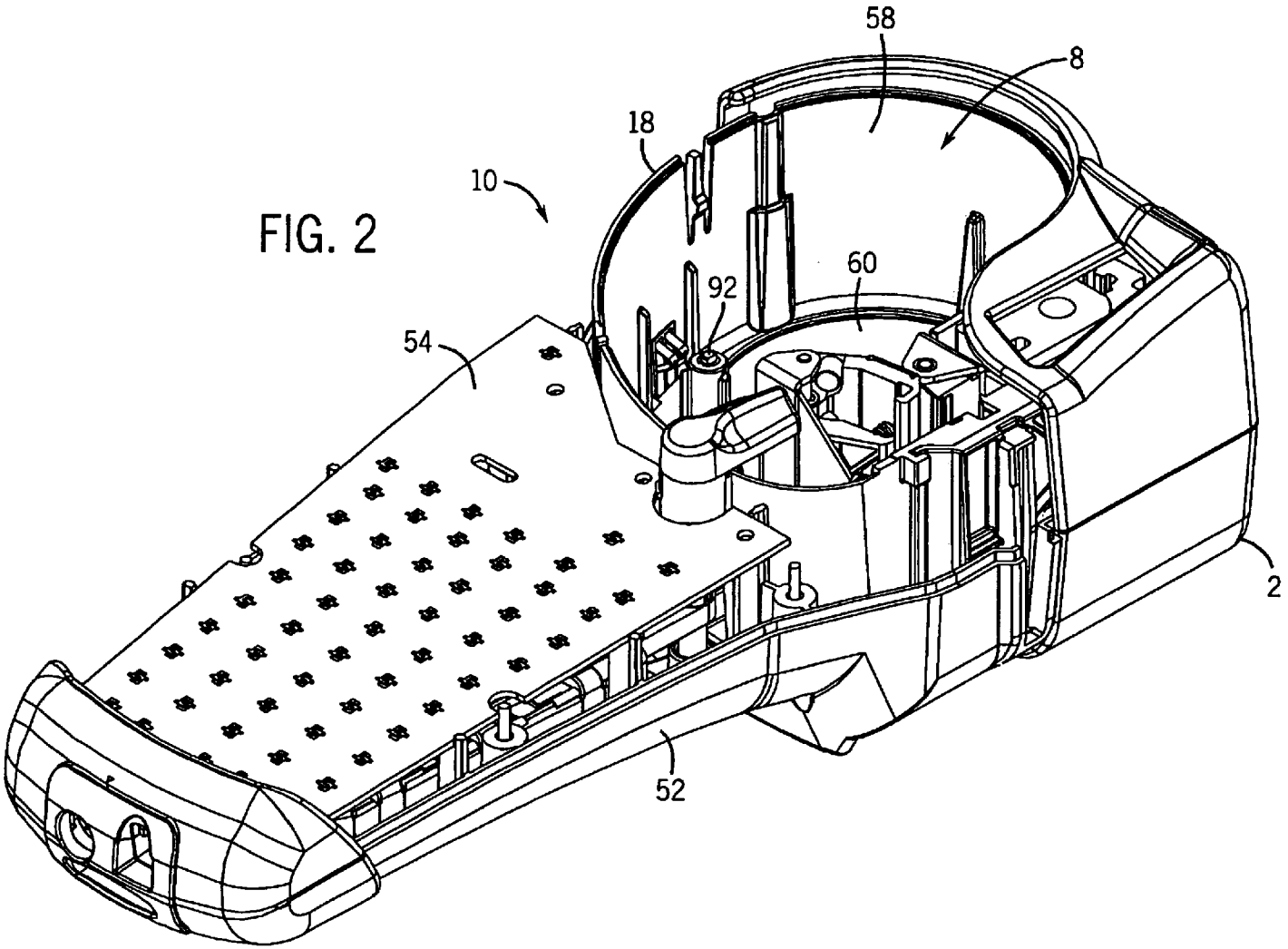
FIG. 2 is a perspective view of the printer of FIG. 1 with the cartridge and top portion, keyboard, and display removed.
Figure 3:
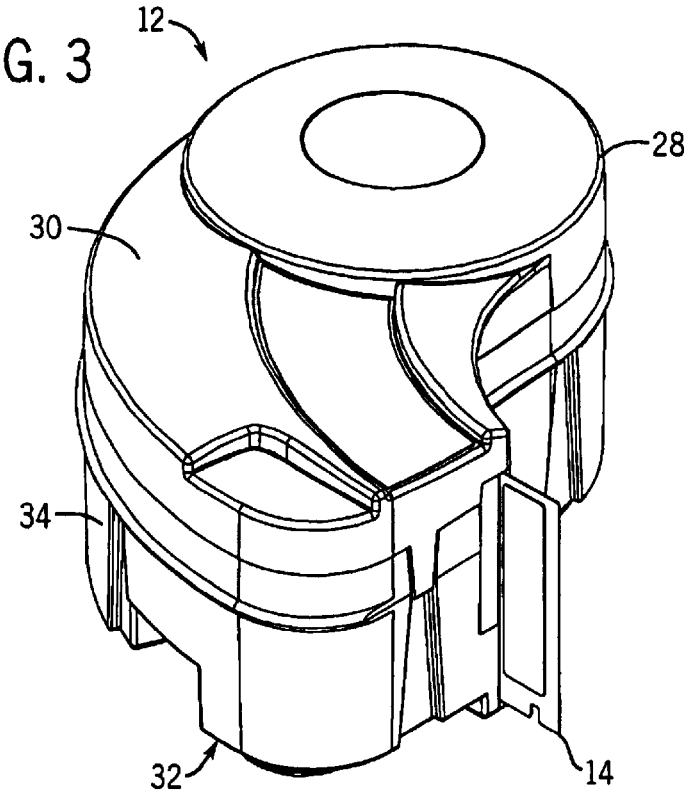
FIG. 3 is a top perspective view of the cartridge of FIG. 1.
Figure 4:
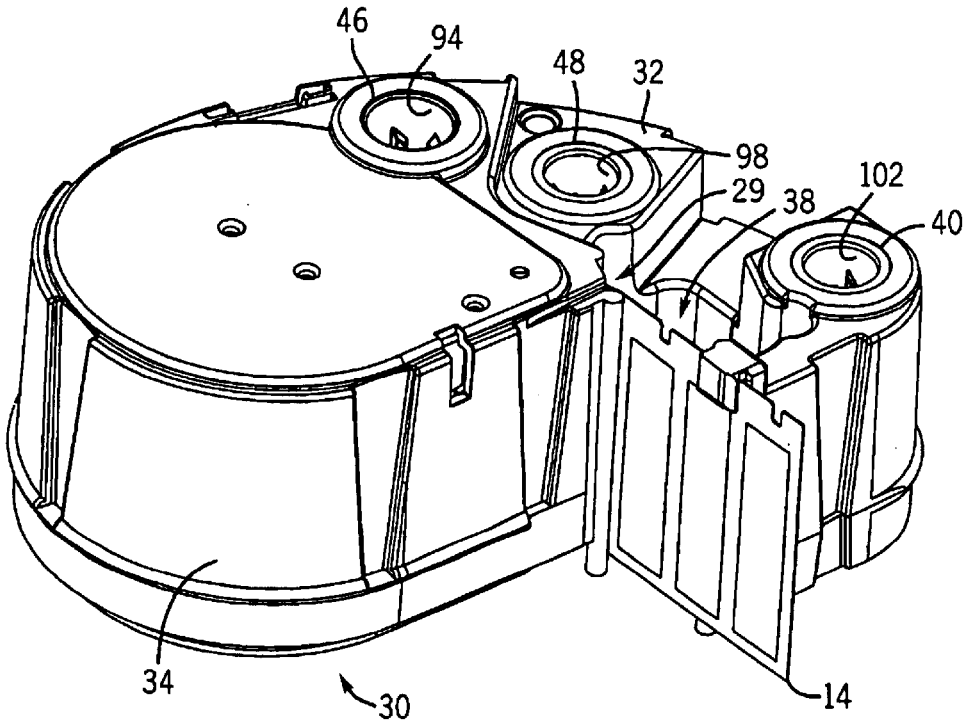
FIG. 4 is a bottom perspective view of the cartridge of FIG. 1.
Figure 5:
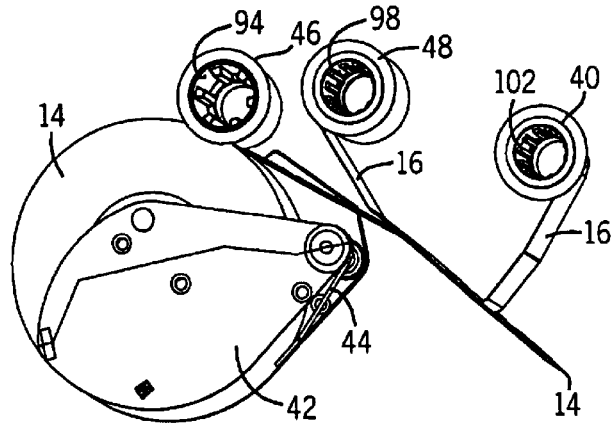
FIG. 5 is a bottom view of the cartridge of FIG. 1 with the top, bottom, and periphery wall removed.
Figure 7:
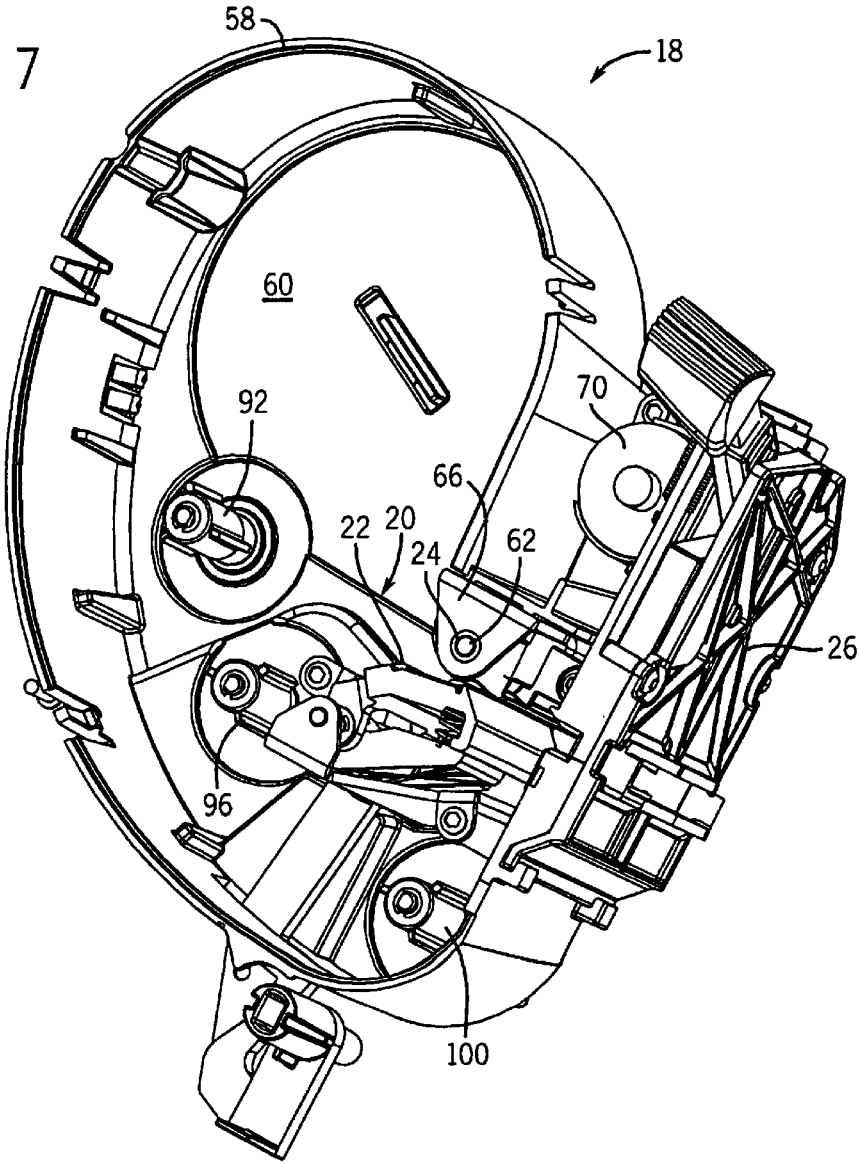
FIG. 7 is a perspective view of the cartridge receptacle of the printer of FIG. 1.
Figure 6:
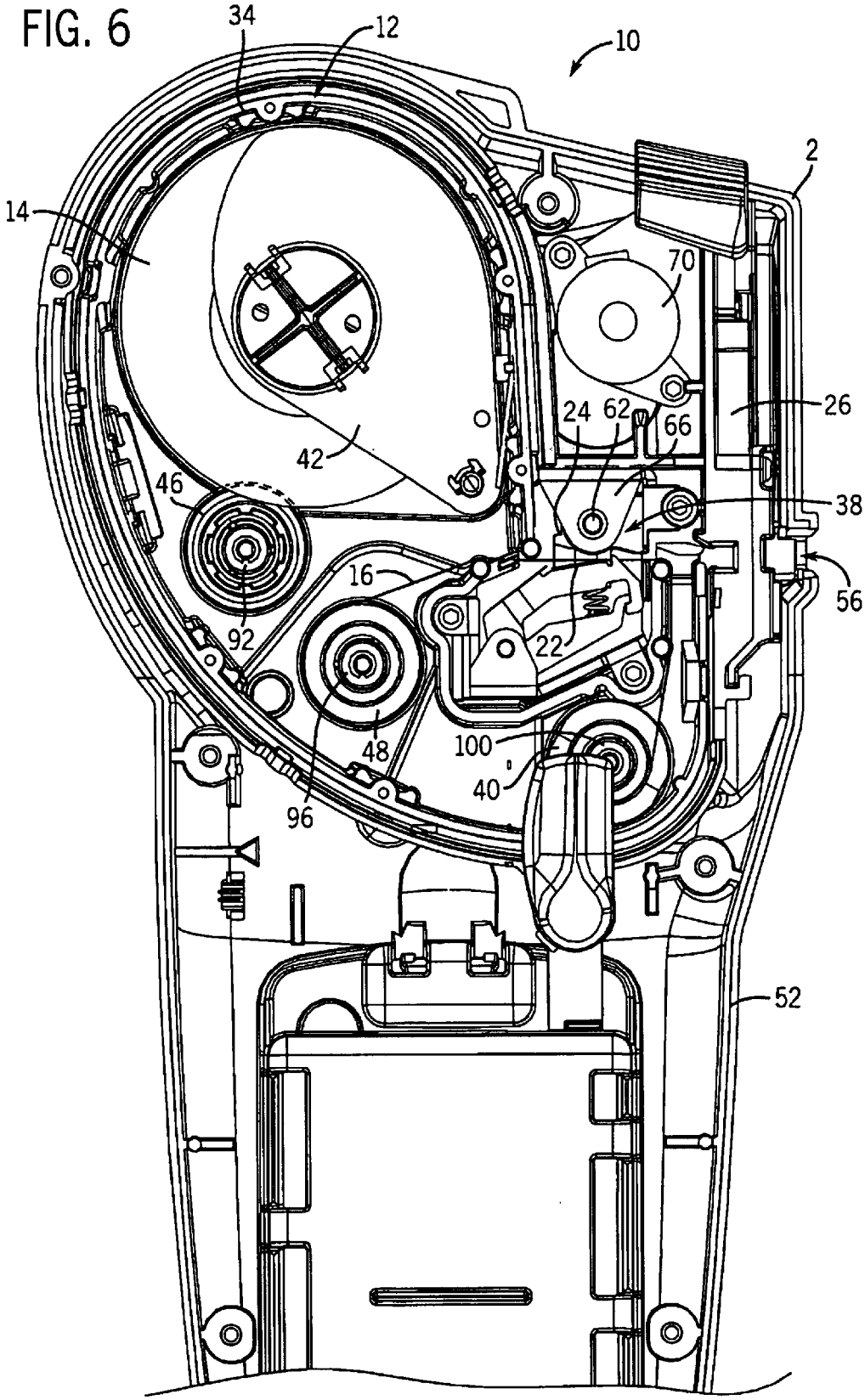
FIG. 6 is a top view of the cartridge of FIG. 1 received in the cartridge receptacle with the top wall of the cartridge removed.
Figure 8:
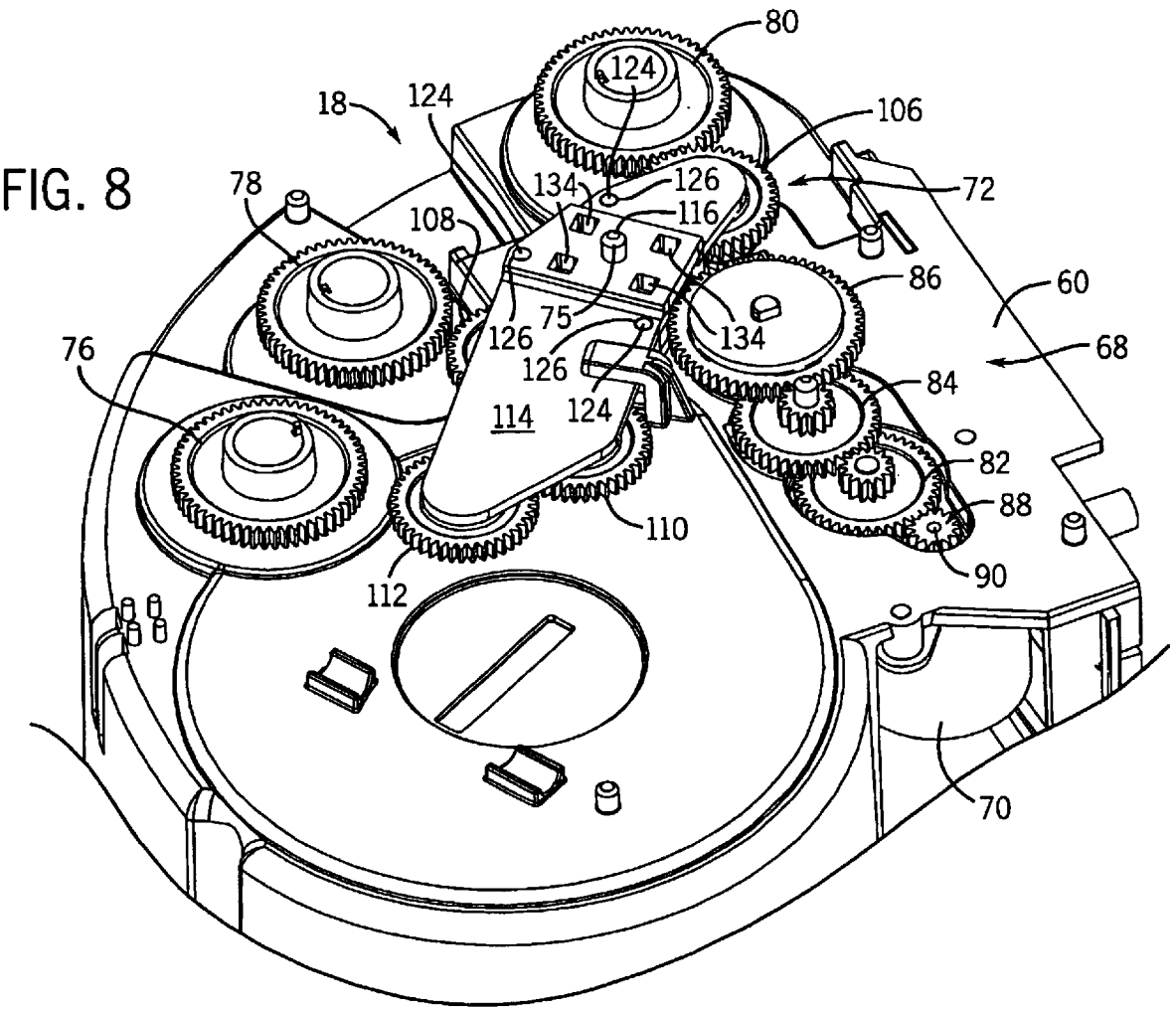
FIG. 8 is a detailed bottom perspective view of the cartridge receptacle of FIG. 6.
Figure 9:
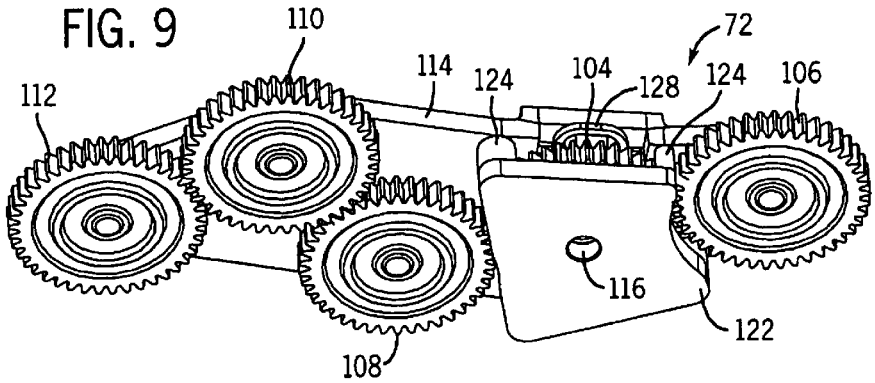
FIG. 9 is a bottom perspective view of the pivotal gear assembly of FIG. 8.
Figure 10:
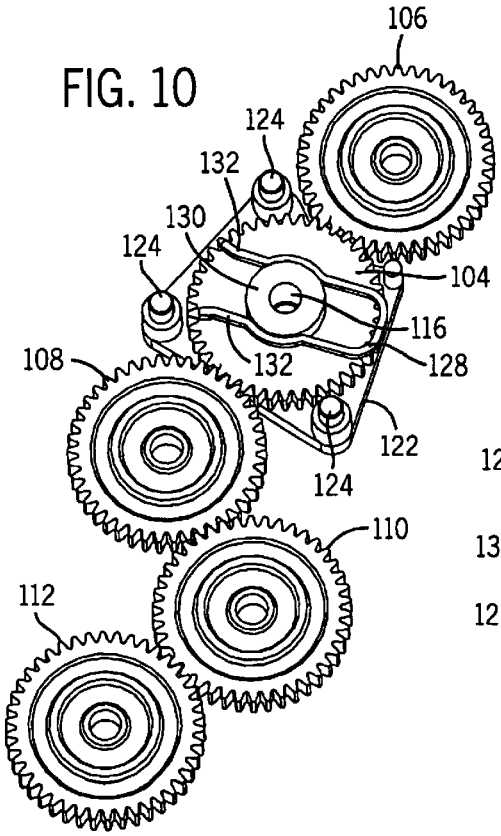
FIG. 10 is a top perspective view of the pivotal gear assembly of FIG. 9 with the gear plate removed.
Figure 11:
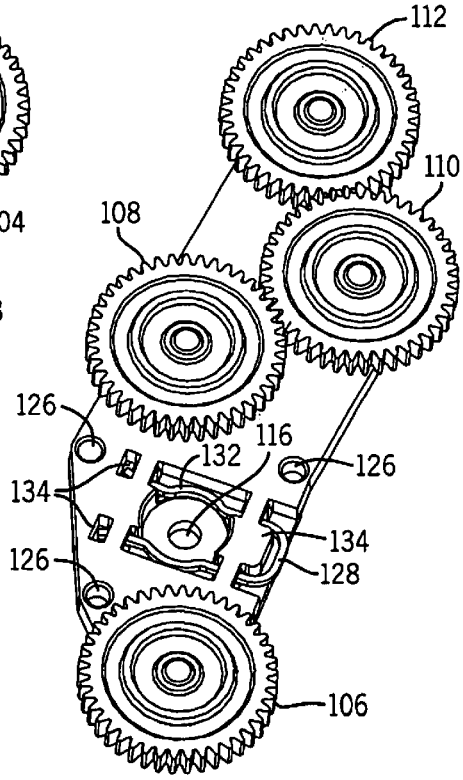
FIG. 11 is a bottom perspective view of the pivotal gear assembly of FIG. 9 with the cradle and pivoting gear removed.

Referring particularly to FIGS. 1–7, a hand held thermal printer 10 employing a preferred embodiment of the present invention includes a molded plastic housing 2 that supports a keyboard 4 on its front surface and a display 6 positioned above the keyboard 4. An opening 8 formed in the housing 2 above the display 6 receives a cartridge 12 containing label media 14 and an ink ribbon 16. The cartridge 12 is inserted through the opening 8 into a cartridge receptacle 18 housed in the printer housing 2, and the label media 14 and ink ribbon 16 from the cartridge 12 are threaded through a printer mechanism assembly 20 including a print head 22 and a platen roller 24 for printing indicia on labels forming part of the label media 14. The printed labels pass through a cutter mechanism 26 which cuts the label media 14 to separate the printed labels from unprinted labels.

The label media 14 is known in the art, and generally comprises a carrier web which supports a series of adhesive labels. The size, width, color, and type of web material varies depending upon the particular print application. The label media 14 is dispensed from the cartridge 12, and urged along a web path as it is consumed by the printer 10.

Referring to FIGS. 3–6, the cartridge 12 includes a cartridge housing 28 having a top wall 30 and a bottom wall 32 joined by a periphery wall 34. The periphery wall 34 defines a media and ink ribbon container for housing the label media and ink ribbon on spools. The label media 14 and ink ribbon 16 from the cartridge housing 28 pass out of the cartridge housing 28 and through an exit slot 29 and into a printing area 38 external to the cartridge housing 28 for engagement with the platen roller 24 and print head 22. The used ink ribbon 16 reenters the cartridge housing 28, and is wound onto an ink ribbon take up spool 40 rotatably mounted in the cartridge housing 28.

The label media 14 is housed in the cartridge housing 28 in the form of a roll rotatably mounted on a yoke 42. The yoke 42 is pivotally mounted between the top and bottom walls 30, 32 of the cartridge housing 28, and is pivotally biased by a spring 44 toward a label media drive roller 46 rotatably mounted between the top and bottom walls 30, 32 of the cartridge housing 28. Advantageously, the spring 44 biases the roll of label media 14 against the label media drive roller 46 to maintain the label media drive roller 46 in contact with the roll of label media 14 as the diameter of the roll of label media 14 decreases during use.

An ink ribbon supply spool 48 rotatably supported between the top and bottom walls 30, 32 of the cartridge housing 28 has a roll of ink ribbon 16 wound thereon. The ink ribbon 16 unwinds from the ink ribbon supply spool 48 and passes out of the cartridge 12 with the label media 14 through the printing area 38 between the print head 22 and platen roller 24. The print head 22 engages the ink ribbon 16 to transfer ink on the ink ribbon 16 onto the label media 14. Once the ink has been transferred, the ink ribbon 16 reenters the cartridge 12, and is wound onto the ink ribbon take up spool 40 supported between the top and bottom walls 30, 32. The cartridge housing 28 frictionally engages both the ink ribbon supply and take up spools 48, 40 to induce a drag, or torque level, on the rotating ink ribbon supply and take up spools 48, 40 in order to maintain tension in the ink ribbon 16. The drag can be adjusted to a desired level using methods known in the art, such as washers, springs, and the like, without departing from the scope of the invention.

Referring back to FIGS. 1–3, the cartridge 12 is received in the cartridge receptacle 18 housed in the printer housing 2. The printer housing 2 is, preferably, formed from at least two portions 50, 52, and houses printer components, such as the cartridge receptacle 18, the keyboard 4, display 6, the cutter mechanism 26, a printed circuit board 54 having printer circuitry, and the like. The opening 8 formed in the housing top portion 50 provides access to the cartridge receptacle 18 for insertion of the cartridge 12 into the cartridge receptacle 18. A slot 56 formed in the housing 2 adjacent the cutter mechanism 26 provides an exit for label media 14 (FIG. 5) which has passed through the cutter mechanism 26.

Referring to FIGS. 6–12, the cartridge receptacle 18 has a periphery wall 58 generally shaped to conform with the cartridge periphery wall 34, and a bottom wall 60 that supports the cartridge 12 therein. The cartridge receptacle periphery wall 58 surrounds the printer mechanism assembly 20 which is fixed in the printer housing 2 relative to the cartridge receptacle 18.

The printer mechanism assembly 20 includes the pivotable print head 22 and stationary platen roller 24. The print head 22 cooperates with the ink ribbon 16 and the label media 14 such that the print head 22 can print characters or symbols on the label media 14. This is described in greater detail in U.S. Pat. No. 5,078,523 which is incorporated herein by reference.

The label media 14 and ink ribbon 16 passing through the printing area 38 are advanced past the print head 22 by the platen roller 24 which maintains the ink ribbon 16 and label media 14 in close cooperation with the print head 22. The platen roller 24 is mounted on a platen roller drive shaft 62 which is rotatably mounted in the cartridge receptacle 18 by a bracket 66. The print head 22 is pivotally mounted relative to the platen roller 24 in the cartridge receptacle 18 to provide space between the print head 22 and platen roller 24 when threading the label media 14 and ink ribbon 16 therebetween.

The platen roller 24, label media drive roller 46, ink ribbon supply spool 48, and ink ribbon take up spool 40 are all rotatably driven by a dual feed direction drive mechanism including a single drive motor 70. The drive motor 70 can rotatably drive the rollers 24, 46 and spools 40, 48 in a forward feed direction and a reverse feed direction. In the forward feed direction, platen roller 24 is rotatably driven to pull the label media 14 and ink ribbon 16 out of the cartridge 12 and the ink ribbon take up spool 40 is rotatably driven to maintain tension in the ribbon between the platen roller 24 and ink ribbon take up spool 40. The label media drive roller 46 and ink ribbon supply spool 48 are not rotatably driven, and drag induced on the label media drive roller 46 and ink ribbon supply spool 48 maintains tension in the label media 14 and ink ribbon 16 as they are pulled by the platen roller 24.

In the reverse feed direction, the platen roller 24 drives the label media 14 and ink ribbon 16 back into the cartridge 12. The label media drive roller 46 is rotatably driven to maintain tension in the label media 14 between the platen roller 24 and label media drive roller 46. The ink ribbon supply spool 48 is rotatably driven to wind the ink ribbon 16 thereon and maintain tension in the ink ribbon 16 between the platen roller 24 and ink ribbon supply spool 48. The ink ribbon take up spool 40 is not rotatably driven, and drag induced on the ink ribbon take up spool 40 maintains tension in the ink ribbon 16 being pulled off of the ink ribbon take up spool 40 by the platen roller 24. Advantageously, the drive mechanism includes a gear assembly that selectively, simultaneously drives the rollers 24, 46 and spools 40, 48 to synchronize the operation of the platen roller 24, label media drive roller 46, ink ribbon supply spool 48, and ink ribbon take up spool 40 to smoothly urge the ink ribbon 16 and label media 14 in the forward and reverse feed directions.

Referring back to FIGS. 4–12, the gear assembly includes a stationary drive gear assembly 68 and a pivotal drive gear assembly 72 that drive the label media 14 and ink ribbon 16 in the forward and reverse feed directions using the single drive motor 70. The stationary drive gear assembly 68 includes a label media drive gear 76, ink ribbon unwind drive gear 78, ink ribbon rewind drive gear 80, first and second intermeshed gears 82, 84, and a platen roller drive gear 86. The first and second intermeshed gears 82, 84 transmit power from a pinion 88 to the platen roller drive gear 86 engaging the pivotal drive gear assembly 72. The gears 76, 78, 80, 82, 84, 86 forming part of the stationary drive gear assembly are rotatably mounted to the underside of the receptacle bottom wall 60.

The pinion 88 is rotatably driven by the motor 70 fixed to the cartridge receptacle 18, and rotatably drives the first intermeshed gear 82. The motor 70 includes a motor shaft 90 that extends through the receptacle bottom wall 60 with the pinion 88 fixed to the motor shaft 90. The printer circuitry energizes the motor 70 to rotatably drive the motor shaft 90, and thus the pinion 88.

The first intermeshed gear 82 engaging the pinion 88 rotatably drives the adjacent second intermeshed gear 84. The second intermeshed gear 84, in turn, engages and rotatably drives the platen roller drive gear 86. The platen roller drive gear 86 also includes a platen roller drive shaft 62 fixed thereto which is coaxial with the platen roller drive gear axis of rotation. The platen roller drive shaft 62 extends through the bottom wall 60 of the cartridge receptacle 18 to rotatably drive the platen roller 24 engaging the label media 14.

The label media drive gear 76 is spaced from the intermeshed and other drive gears 78, 80, 82, 84, 86, and supports a label media drive shaft 92 extending through a bottom wall 60 of the cartridge receptacle 18. The label media drive shaft 92 is coaxial with the axis of rotation of the label media drive gear 76, and engages a radially inner surface 94 of the label media drive roller 46 in the cartridge housing 28 to rotatably drive the label media drive roller 46.

The ink ribbon unwind drive gear 78 is spaced from the intermeshed and other drive gears 76, 80, 82, 84, 86 and supports an ink ribbon unwind drive shaft 96 extending through the bottom wall 60 of the cartridge receptacle 18. The ink ribbon unwind drive shaft 96 is coaxial with the axis of rotation of the ink ribbon unwind drive gear 78, and engages a radially inner surface 98 of the ink ribbon supply spool 48 in the cartridge housing 28 to rotatably drive the ink ribbon supply spool 48 and wind ink ribbon 16 onto the ink ribbon supply spool 48 in a reverse feed direction.

The ink ribbon rewind drive gear 80 is spaced from the intermeshed and other drive gears 76, 78, 82, 84, 86, and supports an ink ribbon rewind drive shaft 100 extending through the bottom wall 60 of the cartridge receptacle 18. The ink ribbon rewind drive shaft 100 is coaxial with the axis of rotation of the ink ribbon rewind drive gear 80, and engages a radially inner surface 102 of the ink ribbon take up spool 40 in the cartridge housing 28 to rotatably drive the ink ribbon take up spool 40 and wind ink ribbon 16 onto the ink ribbon take up spool 40 in the forward feed direction.

The pivotal drive gear assembly 72 is pivotally mounted on a pivot shaft 75 extending from the underside of the receptacle bottom wall 60 relative to the stationary drive gear assembly 68. The pivot shaft 75 rotatably supports a pivoting gear 104 and a gear plate 114. The gear plate 114 rotatably mounts transition gears 106, 108, 110, 112 that selectively engage the drive gears 76, 78, 80 forming part of the stationary drive gear assembly 68. The pivoting gear 104 is rotatably driven by the platen roller drive gear 86 which pivots the gear plate 114 about a pivot point 116 that is coaxial with the axis of rotation of the pivoting gear 104.

The gear plate 114 pivots about the pivot point 116 between a forward feed position (shown in FIG. 8) and a reverse feed position (shown in FIG. 12) to selectively engage one of the transition gears 106, 108, 110, 112 with at least one of the label media drive gear 76, ink ribbon unwind drive gear 78, and ink ribbon rewind drive gear 80. Although pivoting the gear plate 114 about a pivot point 116 coaxial with the axis of rotation of the pivoting gear 104 is preferred, the gear plate 114 can pivot about any pivot point to selectively engage the transition gears 106, 108, 110, 112 with other gears, such as the label media drive gear 76, ink ribbon unwind drive gear 78, ink ribbon rewind drive gear 80, and the first and second intermeshed gears 82, 84, without departing from the scope of the invention. Moreover, although a plurality of transition gears is preferred for driving the ink ribbon in the forward and reverse feed directions, a single transition gear can be provided to engage the ink ribbon unwind gear in the reverse feed position and the ink ribbon rewind gear in the forward feed position without departing from the scope of the invention.

In the forward feed position, the gear plate 114 pivots to engage the first transition gear 106 with the ink ribbon rewind drive gear 80 and to disengage the second and third transition gears 108, 112 from the ink ribbon unwind drive gear 78 and label media drive gear 76, respectively. The pivoting gear 104 rotatably drives the first transition gear 106 in the forward feed direction to drive ink ribbon 16 and label media 14 in the forward feed direction. The rotatably driven ink ribbon rewind drive gear 80 transmits a torque to the ink ribbon take up spool 40 to wind the ink ribbon 16 thereon.

The ink ribbon unwind drive gear 78 is not engaged by one of the transition gears 106, 108, 110, 112 in the forward feed direction to allow the ink ribbon supply spool 48 to rotate relatively freely as ink ribbon 16 is pulled off of the ink ribbon supply spool 48. Preferably, tension is maintained in the ink ribbon by a drag, or torque level, induced by the cartridge 12 on the rotation of the ink ribbon supply spool 48 to prevent jams. The torque transmitted to the ink ribbon supply and take up spools 48, 40 are in opposite directions, and the torque levels are unequal, such that, in the forward feed direction, the ink ribbon supply spool 48 rotates freely relative to the ink ribbon take up spool 40 while maintaining the tension in the ink ribbon 16.

In the reverse feed position, the gear plate 114 pivots to engage the second transition gear 108 with the ink ribbon unwind drive gear 78 and to engage a third transition gear 112 with the label media drive gear 76. The idler transition gear 110 engaging both the second and third transition gears 108, 112 ensures the second and third transition gears rotate in the same direction. The pivoting gear 104 rotatably drives the transition gears 108, 110, 112 to simultaneously drive the label media 14 and ink ribbon 16 in the reverse feed direction.

The ink ribbon rewind drive gear 80 is not engaged by the first transition gear 106 in the reverse feed direction to allow the ink ribbon take up spool 40 to relatively freely rotate as ink ribbon 16 is pulled off of the ink ribbon take up spool 40. Preferably, tension is maintained in the ink ribbon 16 by the cartridge which induces a drag, or torque level, on the rotation of the ink ribbon take up spool 40 to prevent jams. As in the forward feed direction, the torque transmitted to the ink ribbon supply and take up spools 48, 40 are in opposite directions, and the torque levels are unequal. However, in the reverse feed direction, the ink ribbon take up spool 40 rotates freely relative to the ink ribbon supply spool 48 while maintaining the tension in the ink ribbon 16.

The gear plate 114 is rotatably fixed to the pivot shaft 75 extending from the receptacle bottom wall 60 by a cradle 122. Posts 124 extending toward the gear plate 114 past the outer circumference of the pivoting gear 104 are received in holes 126 formed in the gear plate 114 to fix the gear plate 114 relative to the cradle 122, and sandwich the pivoting gear 104 therebetween. The posts 124 can be secured in the holes 126 using a friction fit, adhesive, and the like, to prevent the gear plate 114 from inadvertently separating from the posts 124.

A spring 128 fixed to the gear plate 114 frictionally engages a stub 130 extending from the pivoting gear 104 to pivot in the direction of rotation of the pivoting gear 104. The stub 130 extends toward the gear plate 114 and is coaxial with the axis of rotation of the pivoting gear 104. The spring 128 is U-shaped having legs 132 that engage the outer circumference of the stub 130 and allow the pivoting gear 104 to continue to rotate once the gear plate 114 has pivoted to the desired position. The legs 132 also engage tabs 134 extending from the gear plate 114 which fix the spring 128 relative to the gear plate 114, such that the gear plate 114 pivots about the pivot point 116 with the spring 128 as the pivoting gear 104 rotates. Although frictionally engaging the spring 128 with the stub 130 is preferred, other means for pivoting the gear plate 114, or pivotal gear assembly 72, can be used, such as a cam, actuator, and the like, without departing from the scope of the invention.

Referring to FIGS. 1–12, in use, the cartridge 12 is inserted into the cartridge receptacle 18 with the label media drive shaft 92 received in the label media drive roller 46, the ink ribbon unwind drive shaft 96 received in the ink ribbon supply spool 48, and the ink ribbon rewind drive shaft 100 received in the ink ribbon take up spool 40 to properly position the cartridge 12 in the cartridge receptacle 18 and thread the label media 14 and ink ribbon 16 between the platen roller 24 and print head 22. The print head 22 is then urged toward the platen roller 24 to sandwich the label media 14 and ink ribbon 16 therebetween.

Once the cartridge 12 is locked in place, the printer 10 is ready to produce printed labels. When printing on the labels, the label media 14 and ink ribbon 16 are fed past the platen roller 24 and print head 22 in the forward feed direction by energizing the motor 70 to rotate in a first direction of rotation which in FIG. 8 causes the platen roller drive gear 86 to rotate in a clockwise direction. Rotation of the platen roller drive gear 86 in the clockwise direction causes the pivoting gear 104 to rotate in the counter clockwise direction and pivot the gear plate 114 in the counter clockwise direction until the first transition gear 106 engages the ink ribbon rewind drive gear 80, at which point the gear plate 114 ceases to pivot and the first transition gear 106 rotatably drives the ink ribbon rewind drive gear 80, and thus the ink ribbon rewind drive shaft 100, to wind ink ribbon 16 onto the ink ribbon take up spool 40.

As the ink ribbon take up spool 40 is rotatably driven to wind ink ribbon 16 thereon, the platen roller drive gear 86 rotatably drives the platen roller 24 to urge the label media 14 and ink ribbon 16 past the print head 22. When a desired character is input by an operator or other means, the printer circuitry of the printer 10 energizes pixels on the print head 22 as the label media 14 and ink ribbon 16 advance past the print head 22. The head pixels are variously energized to imprint the character on the label media 14. This is described in greater detail in U.S. Pat. No. 5,078,523 which has been incorporated herein by reference.

When a label has been printed, the drive motor 70 continues to drive the label media 14 and ink ribbon 16 in the forward feed direction to advance the label for removal by the user, such as by cutting the label media 14 using the cutter mechanism 26. Once the portion of the label media 14 containing the printed label is removed, the remaining label media 14 and ink ribbon 16 is fed in the reverse feed direction to position the next available label in position for printing without wasting the label media 14 and ink ribbon 16.

Figure 12:
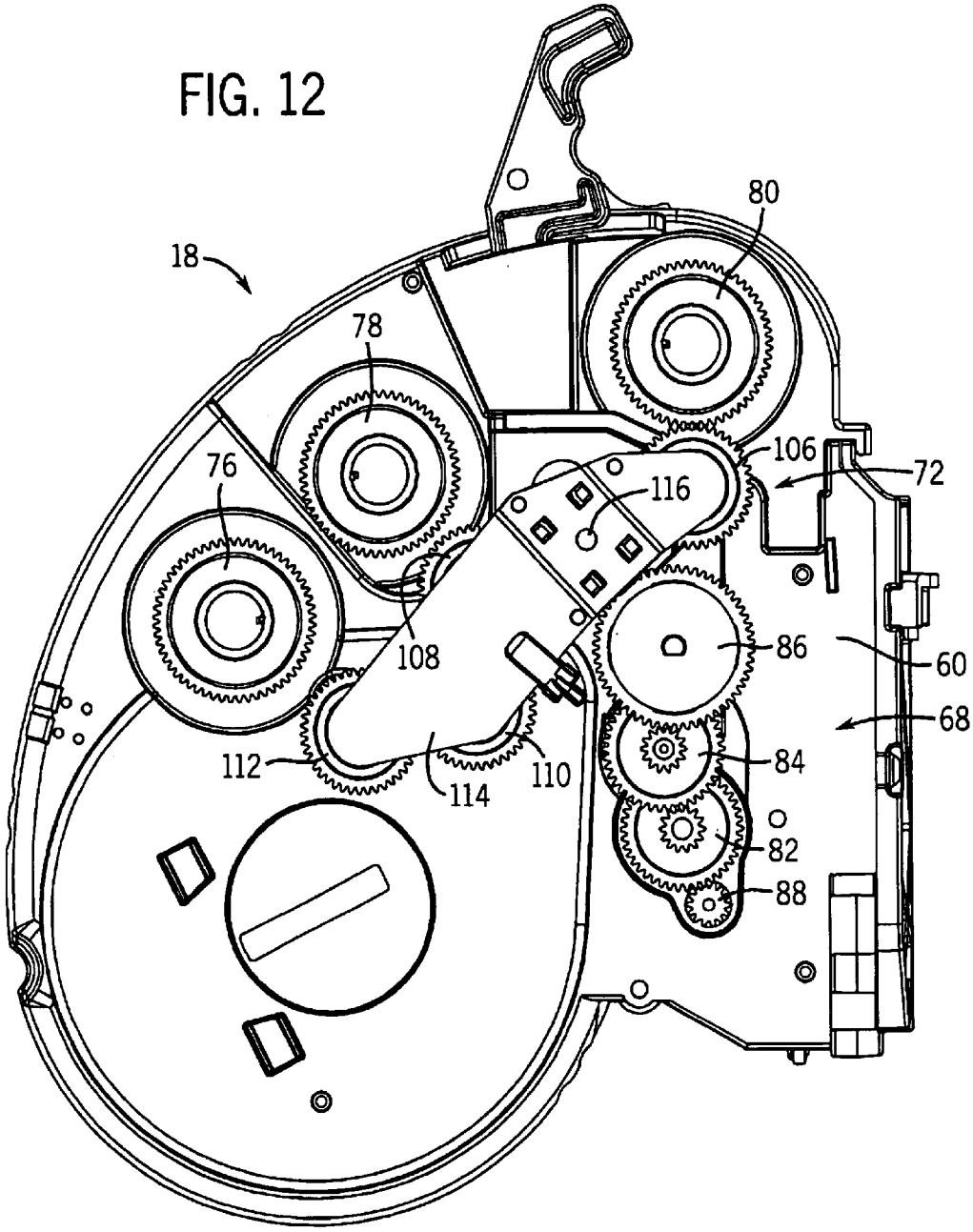
FIG. 12 is a bottom view of the cartridge receptacle of FIG. 7 with the pivotal drive gear assembly in the reverse feed position.

The label media 14 and ink ribbon 16 are fed past the platen roller 24 and print head 22 in the reverse feed direction by energizing the motor 70 to rotate in a second direction of rotation which in FIG. 12 causes the platen roller drive gear 86 to rotate in a counter clockwise direction. Rotation of the platen roller drive gear 86 in the counter clockwise direction causes the pivoting gear 104 to rotate in the clockwise direction and pivot the gear plate 114 in the clockwise direction until the second and third transition gears 108, 112 engage the ink ribbon unwind drive gear 78 and label media drive gear 76, respectively, at which point the gear plate 114 ceases to pivot and the second and third transition gears 108, 112 rotatably drive the ink ribbon unwind drive gear 78, and thus the ink ribbon unwind drive shaft 96, and the label media drive gear 76, and thus the label media drive roller 46, to wind ink ribbon 16 onto the ink ribbon supply spool 48.

As the ink ribbon supply spool 48 is rotatably driven to wind ink ribbon 16 thereon and the label media drive shaft 92 is rotatably driven to pull the label media 14 back into the cartridge 12, the platen roller drive gear 86 rotatably drives the platen roller 24 to urge the label media 14 and ink ribbon 16 past the print head 22 in the reverse feed direction. The pixels on the print head 22, however, remain deenergized to avoid printing on the label as it is being repositioned for printing.

While there has been shown and described what is at present considered the preferred embodiment of the invention, it will be obvious to those skilled in the art that various changes and modifications can be made therein without departing from the scope of the invention defined by the appended claims.

We claim:

1. A printer having a dual direction drive mechanism for driving an ink ribbon in a forward feed direction and a reverse feed direction, said drive mechanism being mounted in a printer body and comprising:

a ribbon rewind gear rotatably mounted in the body for rotatably driving an ink ribbon take up spool to wind the ink ribbon thereon when the ink ribbon is driven in the forward feed direction;

a ribbon unwind gear rotatably mounted in the body and spaced from said ribbon rewind gear for rotatably driving an ink ribbon supply spool to wind the ink ribbon thereon when the ink ribbon is driven in the reverse feed direction;

a rotatably driven drive gear rotatably mounted in the body and spaced from said ribbon unwind gear and said ribbon rewind gear, said drive gear being selectively rotatably driven in a first direction of rotation and a second direction of rotation;

a drive gear assembly pivotally mounted in the body and being pivotable between a first feed position and a second feed position, said drive gear assembly including a pivoting gear and at least one transition gear, said pivoting gear being rotatably mounted in the body about a pivot gear axis and engaging said drive gear and said at least one transition gear, said pivot gear including a stub coaxial with said pivot gear axis, wherein upon rotation of said drive gear in said first direction of rotation, said drive gear assembly pivots about said pivot gear axis from said first feed position to said second feed position to engage said at least one transition gear with said ribbon rewind gear, and upon rotation of said drive gear in said second direction of rotation of said drive gear, said drive gear assembly pivots about said pivot gear axis from said second feed position to said first feed position to disengage said at least one transition gear from said ribbon rewind gear and engage at least one of said at least one transition gear with said ribbon unwind gear; and a spring frictionally engaging an outer circumference of said stub to pivot said gear drive assembly upon rotation of said pivoting gear.

2. The printer as in claim 1, including a media drive gear rotatably mounted in the body, and in said reverse feed position at least one of said at least one transition gear engages said media drive gear to rotatably drive said media drive gear for driving label media in a reverse feed direction.

3. The printer as in claim 1, in which said at least one transition gear is rotatably mounted to a gear plate engageable with said pivoting gear, wherein rotation of said pivoting gear pivots said pivot plate to pivot said drive gear assembly between said forward feed position and said reverse feed position.

4. The printer as in claim 3, in which said spring is fixed to said gear plate.

5. The printer as in claim 1, in which a cartridge receptacle for receiving a cartridge housing an ink ribbon is mounted in said body, and said ribbon unwind gear and said ribbon rewind gear are rotatably mounted to said cartridge receptacle.

6. The printer as in claim 1, in which said drive mechanism includes a single drive motor for rotatably driving said drive gear engaging said pivoting gear to drive the ink ribbon in the forward feed direction and the reverse feed direction.

7. The printer as in claim 1 in which a structure maintains tension in the ink ribbon when driving in the forward feed direction and the reverse feed direction.

8. The printer as in claim 7, in which said ribbon supply and take up spools are disposed in a cartridge, and said structure is said cartridge inducing a drag on at least one of said ribbon supply spool and said ribbon take up spool to maintain tension in the ink ribbon.

9. The printer as in claim 1, in which said drive gear rotatably drives a platen roller.

10. A printer having a dual feed direction drive mechanism for driving an ink ribbon in a forward feed direction and a reverse feed direction, said drive mechanism being mounted in a printer body and comprising:

a stationary gear assembly including a plurality of rotatably mounted gears fixed in the printer body;

a pivotal gear assembly pivotally fixed in the printer body and including at least one rotatably driven gear rotatable about a gear axis, said pivotal gear assembly being pivotable about said gear axis between a forward feed position and a reverse feed position, said at least one rotatably driven gear rotatable about said gear axis including a stub coaxial with said gear axis, wherein in said forward feed position, at least one of said at least one rotatably driven gear engages at least one of said rotatably mounted gears of said plurality of rotatably mounted gears, to drive the ribbon in the forward feed direction, and in said reverse feed position, at least one of said at least one rotatably driven gear engages another of said rotatably mounted gears of said plurality of rotatably mounted gears to drive the ink ribbon in the reverse feed direction, wherein said plurality of rotatably mounted gears in said stationary gear assembly includes a ribbon rewind gear rotatably mounted in the body for rotatably driving an ink ribbon take up spool for winding the ink ribbon thereon and drive the ink ribbon in the forward feed direction, a ribbon unwind gear rotatably mounted in the body and spaced from said ribbon rewind gear for rotatably driving an ink ribbon supply spool for winding the ink ribbon thereon and drive the ink ribbon in the reverse feed direction, and a rotatably driven drive gear rotatably mounted in the body and spaced from said ribbon unwind gear and said ribbon rewind gear; and a spring frictionally engaging an outer circumference of said stub to pivot said gear drive assembly upon rotation of said pivoting gear.

11. The printer as in claim 10, in which said pivotal gear assembly engages at least one rotatably driven gear, and includes a pivoting gear and at least one transition gear, said pivoting gear being rotatably mounted in the body and engaging said drive gear and said at least one transition gear, wherein upon rotation of said drive gear in said first direction of rotation, said drive gear assembly pivots from said first feed position to said second feed position to engage said at least one transition gear with said ribbon rewind gear, and upon rotation of said drive gear in said second direction of rotation of said drive gear, said drive gear assembly pivots from said second feed position to said first feed position to disengage said at least one transition gear from said ribbon rewind gear and engage at least one of said at least one transition gear with said ribbon unwind gear.

12. The printer as in claim 11, including a media drive gear rotatably mounted in the body, and in said reverse feed position at least one of said at least one transition gear engages said media drive gear to rotatably drive said media drive gear for driving label media in a reverse feed direction.

13. The printer as in claim 11, in which said at least one transition gear is rotatably mounted to a gear plate engageable with said pivoting gear, wherein rotation of said gear plate pivots said drive gear assembly about said gear axis between said forward feed position and said reverse feed position.

14. The printer as in claim 13, in which said spring is fixed to said gear plate.

15. The printer as in claim 11, in which a cartridge receptacle for receiving a cartridge housing an ink ribbon is mounted in said body, and said ribbon unwind gear and said ribbon rewind gear are rotatably mounted to said cartridge receptacle.

16. The printer as in claim 11, in which said drive mechanism includes a single drive motor for rotatably driving said drive gear engaging said pivoting gear to drive the ink ribbon in the forward feed direction and the reverse feed direction.

17. The printer as in claim 11 in which a structure maintains tension in the ink ribbon when driving in the forward feed direction and the reverse feed direction.

18. The printer as in claim 17, in which said ribbon supply and take up spools are disposed in a cartridge, and said structure is said cartridge inducing a drag on at least one of said ribbon supply spool and said ribbon take up spool to maintain tension in the ink ribbon.

19. The printer as in claim 10, in which at least one gear of said plurality of rotatably mounted gears rotatably drives a platen roller.

* * * * *